US006471906B1

(12) United States Patent
DeBenedictis et al.

(10) Patent No.: US 6,471,906 B1
(45) Date of Patent: Oct. 29, 2002

(54) ULTRA LOW-TENSION RELAX PROCESS AND TENSION GATE-APPARATUS

(75) Inventors: Mach A. DeBenedictis, Charlotte, NC (US); Virgil J. Adkins, Charlotte, NC (US); Winston A. Phelps, Pineville, NC (US)

(73) Assignee: Arteva North America S.A.R.L., Zurich (CH)

( * ) Notice: Subject to any disclaimer, the term of this patent is extended or adjusted under 35 U.S.C. 154(b) by 202 days.

(21) Appl. No.: 09/613,225

(22) Filed: Jul. 10, 2000

(51) Int. Cl.[7] ..... D02J 1/22

(52) U.S. Cl. ..... 264/342 RE; 28/247; 28/271; 425/446

(58) Field of Search ..... 264/342 RE; 425/446; 28/247, 271

(56) References Cited

U.S. PATENT DOCUMENTS 4,025,595 A 5/1977 Mirhei
4,096,226 A 6/1978 Martin et al.
4,414,169 A 11/1983 McClary
4,491,657 A 1/1985 Saito et al.
4,973,657 A 11/1990 Thaler
5,066,439 A 11/1991 Nishikawa et al.
5,240,667 A 8/1993 Andrews
5,277,858 A 1/1994 Neal
5,925,460 A 7/1999 Hofs et al.

*Primary Examiner*—Leo B. Tentoni
(74) *Attorney, Agent, or Firm*—Gregory N. Clements

(57) ABSTRACT

The invention describes a low tension relax process and corresponding apparatus, wherein a tension gate is incorporated into a relax zone in a yarn production process. The tension gate can be anything that produces a drag on the yarn threadline such as an air drag device, a liquid drag device, or a solid surface contact drag device, or a combination of these. A tension gate is a device which when used in a relax zone has an outlet yarn tension greater than the inlet yarn tension thus creating a tension differential. The tension gate provides a tension differential of at least 5 mg per denier. A relax zone is typical found in a spin-drawing process, a draw-twisting process, a draw-winding process, or a draw-bulking process. The invention describes a yarn making process with a tension gate in the relax zone wherein the tension gate creates a tension differential on said yarn of at least 5 milligrams per denier.

23 Claims, 6 Drawing Sheets

Configuration for One-Roll Tension Gate Device

Relative HAS vs Percent Relax

Measured Threadline Tensions vs Percent Relax

Adjusted Relax Tension vs Percent Relax

Measured Threadline Tensions vs Yarn Stability

Tension Gate Size vs Threadline Stability

Threadline Stability vs Total Relax for Several Tension Gates

Configuration for One-Roll Tension Gate Device

Configuration for Two-Roll Tension Gate Device

Configuration with Multiple Rolls using Approximate Speeds

Configuration Including Four Interminglers Only

Configuration Including an Intermingler and Two Rolls

Configuration with Finish Applicator and Two Rolls

ULTRA LOW-TENSION RELAX PROCESS AND TENSION GATE-APPARATUS

BACKGROUND OF THE INVENTION

1. Field of the Invention

The present invention relates to an ultra low tension relax process and apparatus wherein a tension gate is incorporated into a relax zone in the production of yarn. In particular, the present invention relates to a relax zone wherein yarn is relaxed to control its shrinkage and a tension gate is employed to step wise increase the tension without decreasing the yarn instability. Yarn instability is characterized by lateral yarn movement (on the relax rolls, for example), yarn wrapping, and yarn breaking. The apparatus and process of the present invention has two immediate benefits, namely: 1) when used in the relax zone of a yarn production process, the relax can be significantly increased thereby decreasing the shrinkage of the yarn compared to conventional processes having no such tension gate, and 2) providing a step wise tension increase, compared with conventional apparatus, such that good yarn stability is achieved. Typical processes having a relax zone in yarn production are spin-drawing, draw-twisting, draw-winding, and draw-bulking processes.

2. Prior Art

FIG. 4 of U.S. Pat. No. 4,414,169 to McClary illustrates a typical spin-drawing process. The fibers are spun from a spinneret and subsequently drawn by a series of rolls. After drawing the yarn, conventionally there is a set of rolls being driven at a lower speed than the draw rolls, thereby creating a relax (low tension) zone. As illustrated by the examples, the windup speeds were roughly 2700 meters per minute. The resulting shrinkage measured at 175° C. in air ranges from 4 to 9%.

The reason it was not possible to achieve very high levels of relax in a conventional spin-drawing process, is because at the higher levels of relax there is low yarn tension, which causes yarn wraps around the relax rolls to become very unstable and this often leads to yarn breakage. To provide good yarn stability and prevent yarn breakage, a minimum threadline tension is required. It is not possible to operate below this minimum tension, and thus high levels of relax are not possible with a conventional spin-drawing process. The reason multiple wraps are employed on the relax rolls is to insure that the yarn is moving at a fixed speed as determined by the relax rolls (constant yarn speed is required for the winder to maintain good operation), and to isolate the tension on the winder (this is required to obtain a good package).

U.S. Pat. No. 5,925,460 to Hofs et al discloses, in a spin-drawing process, drawn yarn shrinkages measured at 177° C. ranging from 3.7 to 5.9%. Hofs et al disclose high wind-up speeds in excess of 6000 meters per minute.

U.S. Pat. No. 4,096,226 to Martin et al discloses a spin-drawing-texturizing process for polyamide yarn. The texturizing device (also know as draw-bulking) has an overfeed of 10–50%.

U.S. Pat. No. 4,491,657 to Saito et al discloses a high modulus, low shrink tire yarn. Tables 1 and 2 generally show that as process speed increases, the shrinkage decreases.

U.S. Pat. No. 4,973,657 to Thaler discloses a high modulus, low shrink tire yarn. The table shows that as the residence heating time increases, the shrinkage decreases (compare Example 5 with 6). It also shows that as the temperature decreases, the shrinkage increases (compare Example 4 with 5).

U.S. Pat. No. 5,227,858 to Neal discloses an industrial yarn and shows that as the temperature increases, the shrinkage decreases. This patent also teaches the advantages of employing rolls having a special surface for contacting the yarn.

U.S. Pat. No. 5,066,439 to Nishikawa et al teaches a continuous spin draw process for making polyester yarn, whereby a commingler is introduced between the second draw rolls and the relax rolls just prior to wind-up. In column 4, line 20 Nishikawa et al state that the relaxation ratio can be enhanced greatly by applying the commingling treatment to the yarn between the second draw rolls 6 and the relaxation rolls 10. More specifically, in column 6 line 19–22 it states that the relaxation was done at a ratio of 5 to 12%.

The two tables set forth below summarize the data in Examples 1 & 2 of Nishikawa et al. In particular, Example 1 data shows drawing speeds of about 3000 meters per minute and with relaxation ratios varying from 5 to 12%. The stability of the yarn with the heaters on and off and the commingler (at 28.44 psi) being on and off is shown. Example 1 indicates that whether the heater and commingler are on or off, good stability (no breaks) can result. Example 2 shows drawing speeds of 4500 meters per minute with a constant relax ratio in each instance of 8%. Example 2 demonstrates that when the commingler is operating at approximately 42.66 psi, good stability can only be achieved when the heater is on. Example 2 clearly shows that the improvement in stability is due to the heater, and not the commingler. In other words there is no data showing that commingling alone yields improved stability.

Example 1

| | Drawing Speed | Relax Ratio | Heater | 2 kg/sq. cm = 28.44 psi Commingler | Stability |
|---|---|---|---|---|---|
| 1 | 3100 | 8 | Off | Off | T |
| 2 | 3100 | 10 | On | On | O |
| 3 | 3000 | 5 | Off | Off | O |
| 4 | 3000 | 9 | Off | Off | O-T |
| 5 | 3000 | 12 | On | On | O |
| 6 | 3000 | 12 | On | On | O |
| 7 | 3000 | 12 | On | On | O |

Instability qualitatively measured
O No Breaks
T Some filaments broke, but could wind
X Yam breaks Example 2

| | Drawing Speed | Relax Ratio | Heater | 3 kg./sq. com. = 42.66 psi Commingler | Stability |
|---|---|---|---|---|---|
| 8 | 4500 | 8 | Off | On | T-X |
| 9 | 4500 | 8 | On | On | O |
| 10 | 4500 | 8 | Off | On | T-X |
| 11 | 4500 | 8 | On | On | O |

Instability qualitatively measured
O No Breaks
T Some filaments broke, but could wind
X Yam breaks

SUMMARY OF THE INVENTION

The present invention is an ultra low tension relax process and apparatus positioned within the relax zone of a yarn production process such as a spin-drawing process, a draw-twisting process, draw-winding, or a draw-bulking yarn process. The concept of the present invention is to introduce a tension gate into the relax zone found in any of these processes. The purpose of the tension gate is to enable very high relax levels with ultra low tension such that low shrinkage of the yarn is achieved. Additionally the tension gate provides for significantly improved stability in that no yarn wrapping and no yarn breakage occur when using the tension gate of the present invention in a conventional relax zone. With respect to a conventional spin-drawing process, for example, the tension gate maintains the minimum level of tension necessary for the yarn arriving at the relax rolls, thus preventing breakage, while permitting the yarn to relax between the draw rolls and the tension gate. The tension gate permits yarn relax to exist before the tension gate, while creating an increase in the yarn tension after the tension gate so that yarn instability improves on the wraps on the relax rolls, so that no yarn breakage occurs.

With drawing speeds of less than about 2500 meters per minute, yarn stability is not a major problem. At such speeds good relax percentages can be achieved and yarn stability or breakage is virtually nil. However, as process speeds increase, achieving a high relax ratio becomes more difficult because yarn tension falls as relax is increased, and instability results thereby incurring yarn wrap and breakage. Additionally, trying to achieve increased relaxation in a conventional process, to reduce overall shrinkage creates yarn instability (the yarn traverses from side to side on the relax rolls) resulting in breaks, and/or a poor mechanical quality due to the yarn abrasion from traversing back and forth across the rolls.

The tension gate of the present invention partitions a relax zone in a conventional process into a relax zone and a small stretching zone. Different devices, when positioned in a conventional relax zone can create a partition. Tension gates can be created by applying drag to the yarn, by means of air drag, liquid drag, or drag produced by pulling the yarn over a solid surface. Air drag can be applied to the yarn by employing one or more interminglers or a counter-current air-flow device, for example. Liquid drag can be introduced by employing one or more finish applicators (a finish applicators is a device well known to those in the textile industry, as it applies a liquid finish or coating to the yarn), or by drawing the yarn through a pool of liquid, for example. Solid surface drag can be introduced by contacting the yarn with one or more solid surfaces (like rolls) over or around which the yarn traverses, but because the yarn does not have multiple wraps on a roll, traversing yarn on the tension gate device is not a problem, and does not cause yarn breakage.

In the broadest sense, the present invention relates to a yarn making process having a relax zone for partitioning the tension on the yarn, comprising the step of providing a tension gate in the relax zone which creates a tension differential on the yarn of at least 5 milligrams per denier (mg/d).

Also in the broadest sense, the present invention relates to a tension gate for increasing the tension on yarn with no yarn breakage, comprising employing one or more air, liquid or solid surface drag devices or a combination of these having a yarn tension differential (the yarn tension exiting the tension gate minus the yarn tension entering the tension gate) of at least 5 mg per denier.

BRIEF DESCRIPTION OF THE DRAWINGS

The drawings of the present invention are used to help illustrate, describe, and convey the general concept of the overall invention. Accordingly they are for illustrative purposes only and not meant to limit the scope of the invention and claims in any manner.

DESCRIPTION OF THE PREFERRED EMBODIMENTS

Figure 1:
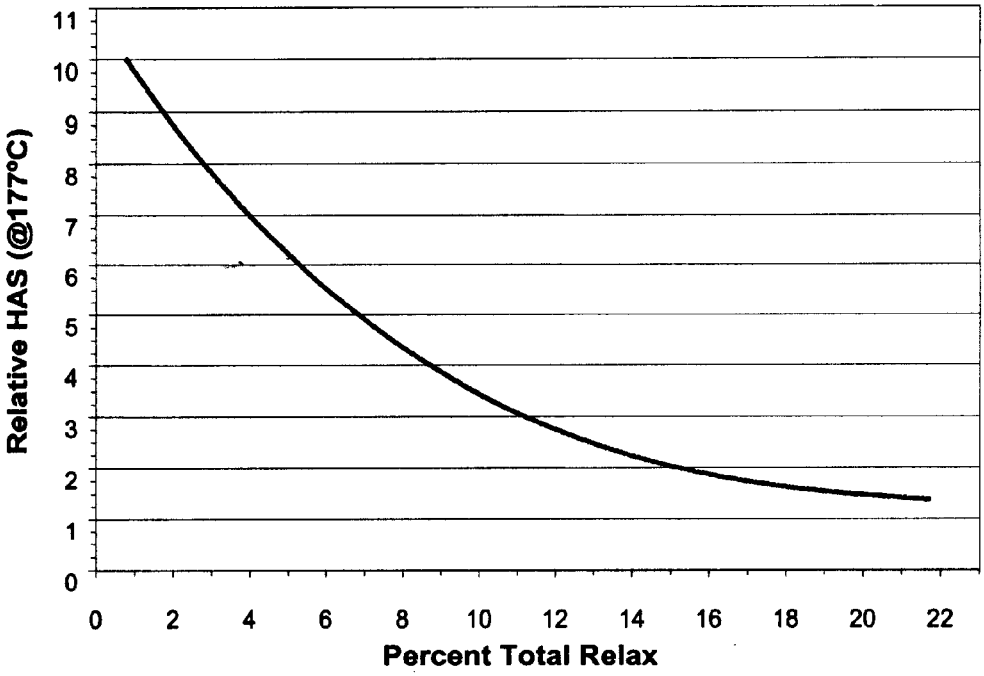
FIG. 1 is a graph showing the relationship of relative hot air shrinkage at 177 ° C. versus percent total relax.

Current processes such as a spin draw process, draw twisting process, draw-winding process, or draw bulking process include a relax zone and thus the process and apparatus of the present invention can be employed in such a relax zone. Any melt-spun polymer employed with any of the above processes such as polyesters, polyamides (nylons), polyolefins, polyketones, polyetherketones, polyphenylene sulfide, and polyarylates can be employed with the present invention. Typical polyesters are polyethylene terephthalate, polybutylene terephthalate, polypropylene terephthalate, polyethylene naphthalate, or a mixture of any of these, or copolymers of any of these polyesters with up to about 15% by weight of polyolefins, poly-alkylene glycol, or other copolyesters such as polyethylene terephthalate isophthalate. Typical nylons are nylon 6 and nylon 66. Typical polyolefins are polyethylene, polypropylene, polybutylene, or a mixture of these. Combinations of any of these polymers, or any one of these polymers with other polymers like polyethylene or polypropylene, in the form of a bicomponent or heterofil fiber are also within the scope of the present invention.

Current yarn processing methods are limited in the level of achievable relax. This is because as the relax level increases, yarn tension in the relax zone decreases, and this causes the yarn to become unstable on the rolls downstream of the relax zone. Unstable yarn is defined as yarn moving, or swaying across the roll surface due to low tension. Highly unstable yarn can lead to a reduction in mechanical quality, and in severe cases, to breakouts (yarn breakage).

When the present process or apparatus of the invention is used in any of the yarn production processes having a relax zone, a higher level of relax and a resulting lower hot air shrinkage can be achieved as compared to conventional processes and apparatuses. By using the present invention at higher processing speeds one can achieve the same level of relax under high speed conditions versus more conventional low speed conditions, or one could maintain the process speed but increase the level of relax such that the hot air shrinkage is greatly improved (reduced), or both can be done simultaneously.

A tension gate is a device which when used in a relax zone of a yarn production process has an outlet yarn tension greater than the inlet yarn tension thus creating a tension differential. Additionally, tension gates of the present invention comprising one or more rolls are non-multiwrap yarn roll devices. The tension differential is generally greater than 5 milligrams per denier (mg/d) such that if the yarn is a 1000 denier yarn, then the tension gate of the present invention is 5 grams, whereas if the yarn has a 2000 denier, then the tension gate is at least about 10 grams. For the present invention a preferred embodiment is a tension gate or a process having a tension differential of at least about 7 mg per denier, and more preferable greater than about 9 mg per denier. Use of the tension gate and process of the present invention in the relax zone of a yarn production system allows higher levels of relax and corresponding significant reductions in hot air shrinkage of the yarn at the same processing speeds.

If we assume that a significant improvement in process speed is 10%, or if we assume that a significant increase in the relax level is 15%, then a tension gate which has about 7 mg per denier of tension differential between the yarn leaving the tension gate versus the yarn entering the tension gate achieves the significant improvement. This is the preferred embodiment. Of course, good stability can result even when the process speed is improved less than 10% and/or the relax level is increased less than 15%. Such results are not characterized as a "significant improvement", but are within the scope of the present invention.

At speeds of 5000 meters per minute, achieving a level of relax of approximately a maximum of about 7% was very difficult with the conventional equipment employed for these experiments due to the instability of the yarn. When employing a tension gate of the present invention using only two rolls, for example, one can achieve a higher level of relax of about 9% and obtain a corresponding lower hot air shrinkage. Additionally, with the addition of more tension gate devices, such as interminglers or more rolls, the percent relax can be even greater (with a corresponding hot air shrinkage decrease).

Of course, the present invention also has application with more typical spin-drawing process speeds of around 3000–3500 meters per minute. At these speeds, with no tension gate, yarn produced by spin-drawing, using the equipment and conditions employed for these experiments, can achieve a relax of about 12%, whereas when utilizing the present invention, the relax can be about 17% and achieve a lower hot air shrinkage while maintaining good yarn stability. The increase in relax from 12% to 17% is a 40% increase (a significant increase as defined above). If more tension gates are employed, even greater percentages of relax can be obtained with lower hot air shrinkages. This relationship is demonstrated in FIG. 1 for a spin-drawing process.

FIG. 1 is a graph of the relationship of hot air shrinkage (at 177° C.) versus percent relax. The spin-drawing process data is a compilation at speeds of 2700, 3200, 3700, 4250, and 5000 meters per minute at a spun yarn intrinsic viscosity (IV) of 0.88 measured in a orthochlorophenol solution at 25° C. Regardless of the speed of the yarn leaving the roll prior to the tension gate, there is a relationship between hot air shrinkage (HAS) and percent yarn relax. FIG. 1 shows that HAS can be reduced by increasing the level (percentage) of relax. The curve shown is specific for the resin employed in these examples and is affected by the intrinsic viscosity, temperature (heat set temperature), draw ratio, residence time, heating time, resin composition. Varying one or more of these factors will shift the curve up, down, left or right, depending on which factor is varied. The important point is that HAS decreases as the percent relax increases, all other conditions being held constant.

Figure 2:
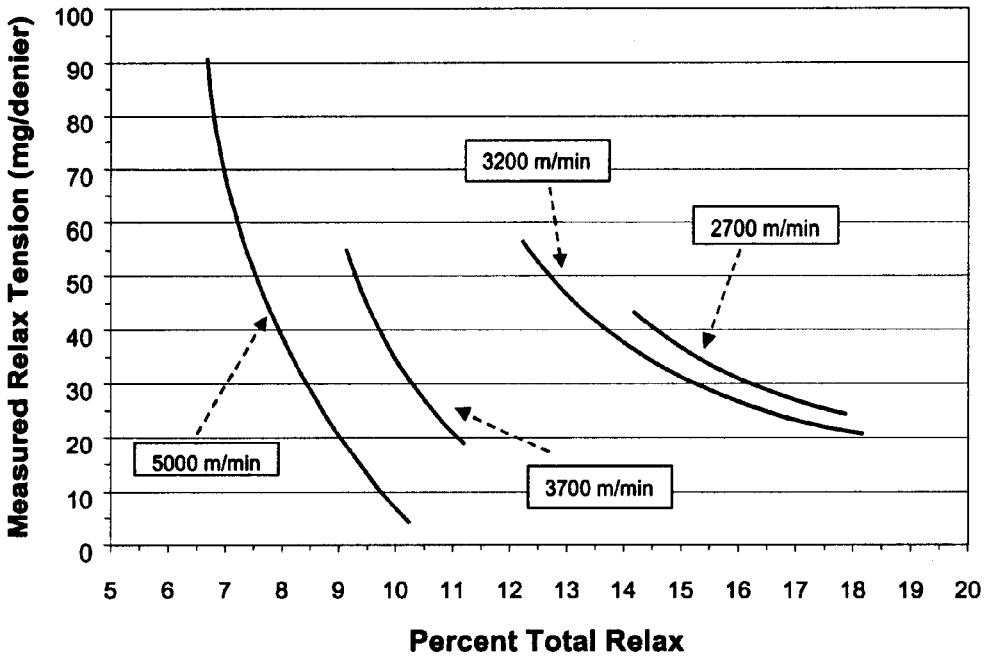
FIG. 2 is a graph of measured threadline tension in milligrams per denier versus percent relax at various yarn speeds.

FIG. 2 is a graph showing the relationship between measured threadline tension and percent relax at various process speeds (the speed of the last set of draw rolls) of 2700 m/min, 3200 m/min, 3700 m/min, and 5000 m/min. At each process speed the relationship is the same, namely as the percent relax increases, the measured tension decreases, and vice-versa. The curves shown are specific for the resin employed in these examples and are affected by the intrinsic viscosity, temperature (heat set temperature), draw ratio, residence time, heating time, resin composition. Varying one or more of these factors will shift the curves up, down, left or right, depending on which factor is varied. The differences between the curves at the various process speeds are mainly due to the centrifugal force error in the tension measuring device. After correcting for this error, the data for all speeds forms a continuous relationship as shown in FIG. 3.

Figure 3:
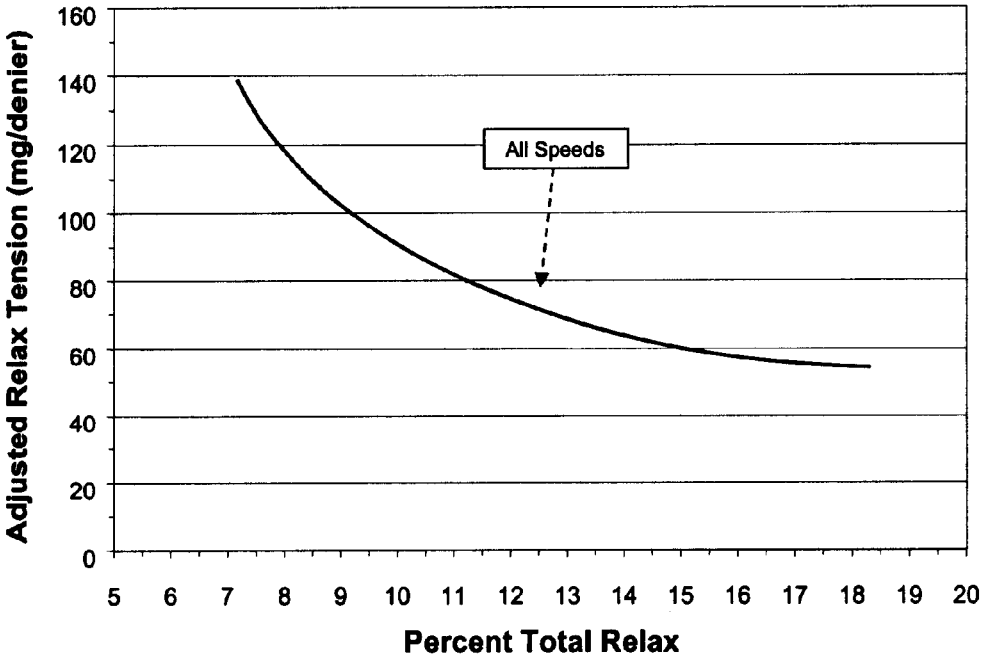
FIG. 3 is a graph of adjusted threadline tension in milligrams per denier versus percent relax for any yarn speed.

FIG. 3 shows how the tension in the threadline decreases as the level of relax is increased. The data in this graph is also a compilation of data at the processing speeds described with respect to FIG. 2. The data has been corrected for a centrifugal force error in the tension-measuring device. The tension-measuring device has a spring-loaded roll and the amount of tension in a threadline pushes against the spring and some tension value is indicated. The adjusted tension in milligrams per denier takes into account the force of the spring in the measurement device, the rotational drag of the roll, the centrifugal force on the yarn as it moves around the measurement roll, as well as the threadline tension value. The curve shown is specific for the resin employed in these examples and is affected by the intrinsic viscosity, temperature (heat set temperature), draw ratio, residence time, heating time, resin composition. Varying one or more of these factors will shift the curve up, down, left or right, depending on which factor is varied. As the percent relax increases, the threadline tension decreases, all other conditions being held constant.

Figure 4:
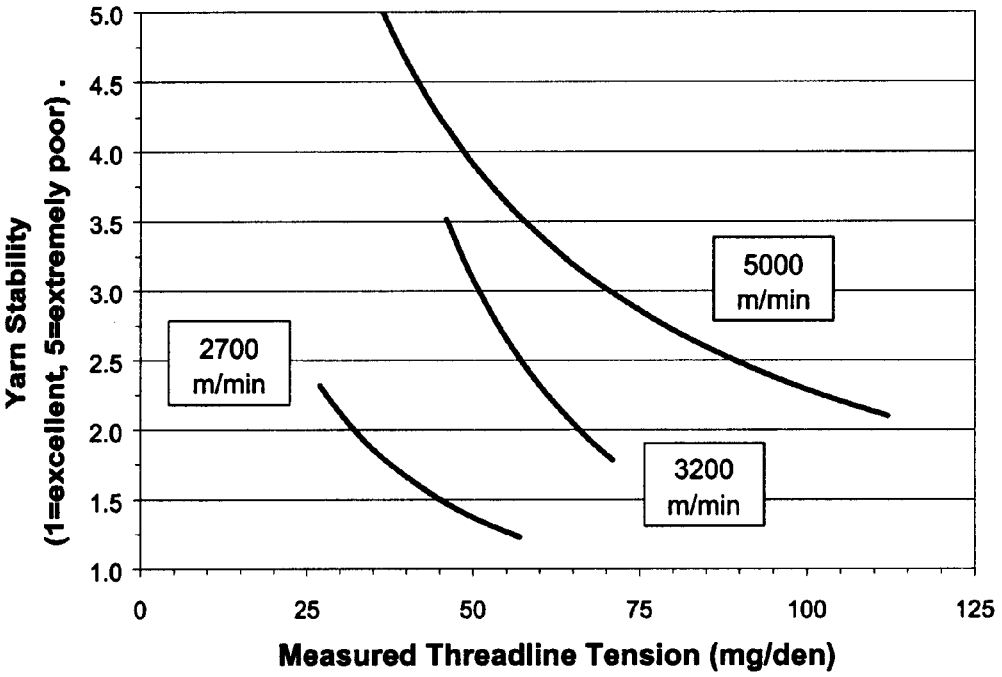
FIG. 4 is a graph of the relationship between measured threadline tension versus yarn stability.

FIG. 4 are graphs of measured threadline tensions in mg/d versus yarn stability at various process speeds (the speed of the last set of draw rolls). The curves shown are specific for the resin employed in these examples and is affected by the intrinsic viscosity, temperature (heat set temperature), draw ratio, residence time, heating time, resin composition. Varying one or more of these factors will shift the curves up, down, left or right, depending on which factor is varied. For better stability at any speed you need a higher threadline tension. This is because the centrifugal force on the yarn, as it traverses around a roll is greater at higher speeds and requires greater tension in the zone to maintain good yarn stability. A subjective scale is used to define the yarn stability. A rating of 1 (excellent) is defined as extremely stable with no threadline movement or swaying, while a rating of 5 (extremely poor) is defined as sufficient yarn movement that the threadline immediately breaks. A rating of 3.0 to 3.5 is considered the maximum level of instability permitted in a manufacturing process. Thus, FIGS. 2 and 4 show that for a given level of stability, of 3.0 to 3.5 is considered the maximum level of instability permitted in a manufacturing process. Thus, FIGS. 2 and 4 show that for a given level of stability, the level of relax that can be achieved is reduced as process speed is increased, i.e., at a given yarn tension, as you increase speed, the stability becomes worse (instability increases).

Figure 5:
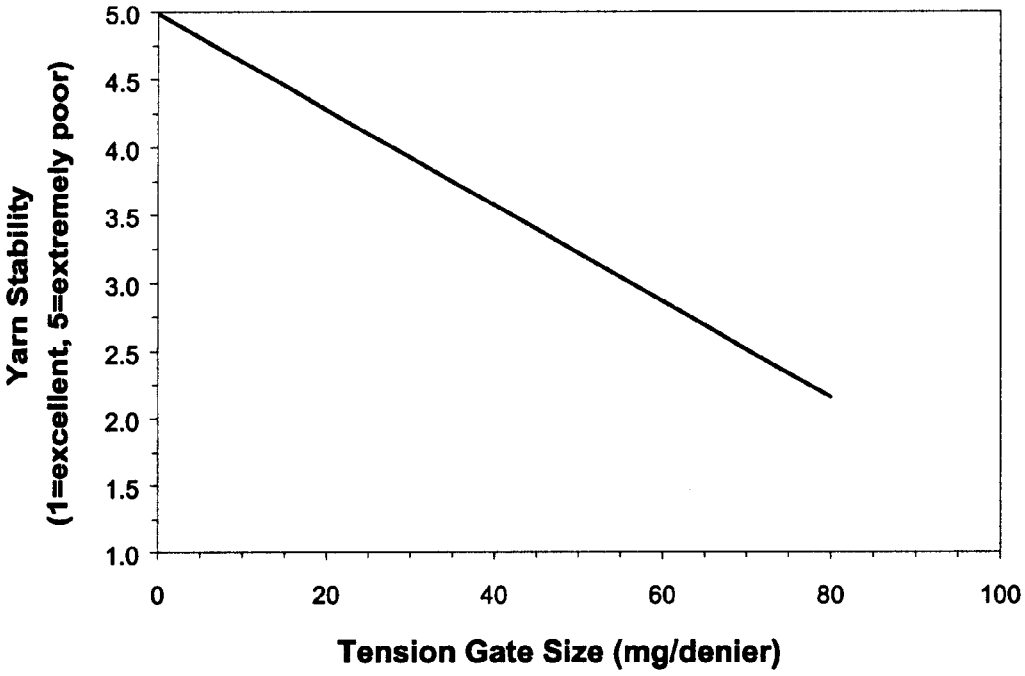
FIG. 5 is a graph of tension gate size in milligrams per denier versus threadline stability.

FIG. 5 shows the relationship between the tension gate size in mg/d and threadline or yarn stability at a level of relax of 8 to 9 percent, at a constant speed of 5000 m/min. The stability improves with an increase in the tension gate size. A tension gate of 0 mg/d could not be determined because the threadline continually broke. Therefore the yarn stability was determined at a 7% relax and the results were extrapolated to 0 mg/d to complete the graph. In other words, at 5000 m/min, the yarn stability was extremely poor, at a level of relax of 8 to 9%. To have a minimally acceptable yarn stability (about 3.5) at 5000 m/min, the necessary tension gate for the equipment and conditions of these experiments is about 40 mg/d. Other equipment and conditions would yield different results, but the relationships or general principles remain the same.

Figure 6:
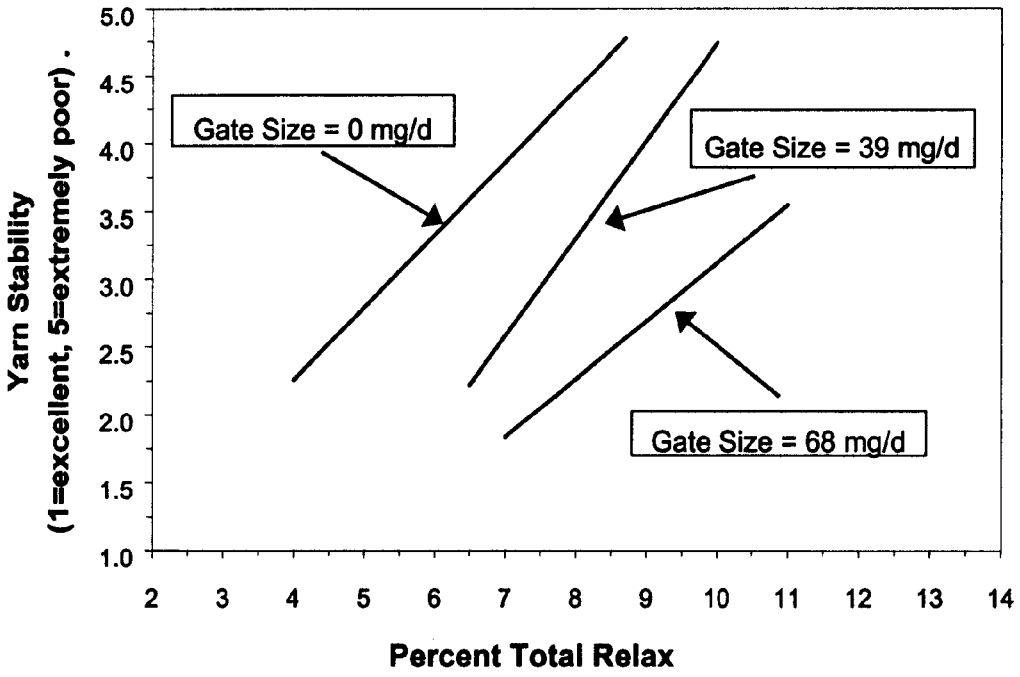
FIG. 6 is a graph of threadline stability versus percent relax for a control having no tension gate, for a tension gate of 39 mg/d, and for a tension gate of 68 mg/d.

FIG. 6 are graphs showing the relationship between yarn or threadline stability and percent relax, at various tension gate sizes, including a control having no tension gate. The tension gate graph at 39 mg/d is the average gate size for a two roll tension gate. The tension gate graph at 68 mg/d is the average gate size for a finish applicator with two rolls as the tension gate device. These graphs illustrate how the relax/stability relationship improves with the addition of a gate device of the present invention, which produces tension gates of various sizes.

Figure 7:
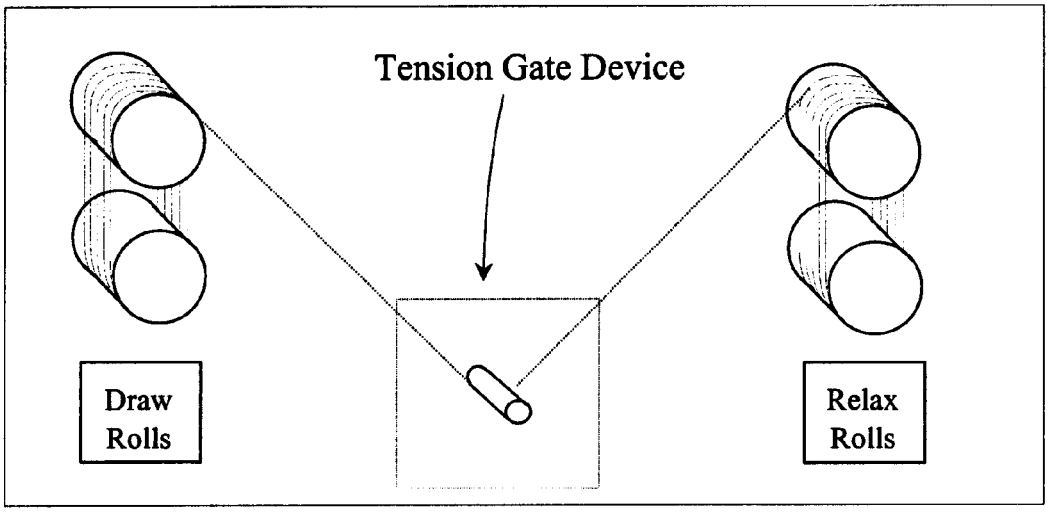
FIG. 7 schematically illustrates employing a single roll as a tension gate.

FIG. 7 schematically illustrates a one-roll tension gate positioned between the draw rolls and the relax rolls. The tension gate partitions the tension in the relax zone so that better yarn stability occurs on the relax rolls.

Figure 8:
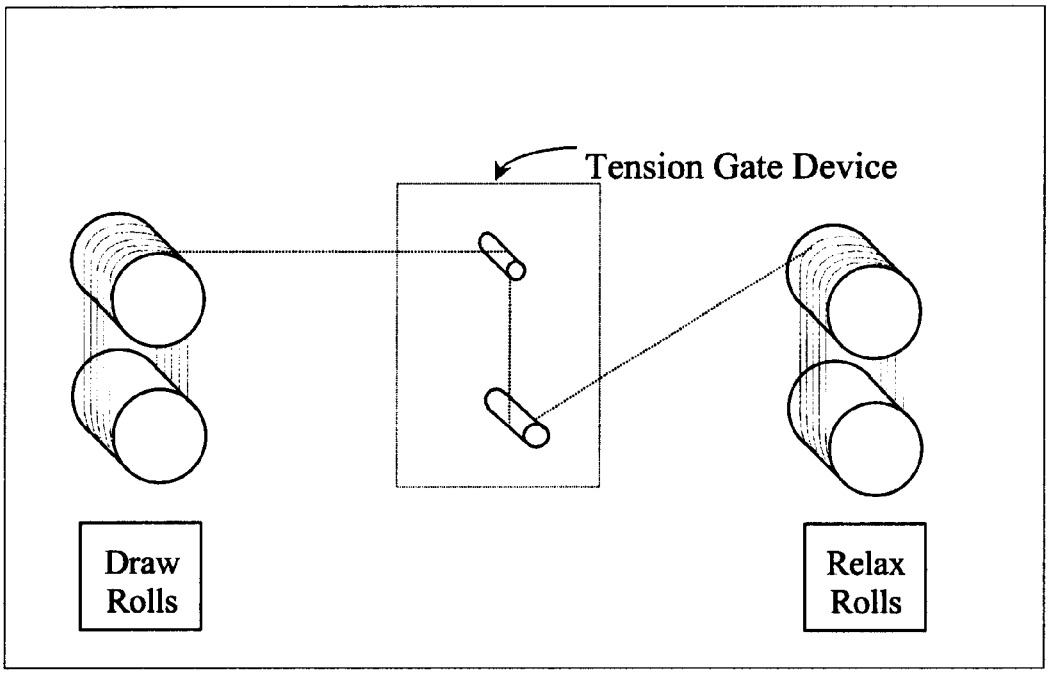
FIG. 8 schematically illustrates a pair of rolls as the tension gate.

FIG. 8 schematically illustrates a two roll tension gate device positioned within the relax zone. The measured tension in the relax zone is about 5 mg/d, which is very low thereby permitting the yarn to substantially relax. As the yarn enters the tension gate device, the yarn tension between the first and second rolls is increased gate device and the relax roll is approximately 85 mg/d. This is a tension gradient of approximately 53 mg/d (85–32). A tension of approximately 85 mg/d is sufficient to insure yarn stability. As illustrated, the overall tension entering the tension gate device is about 5 mg/d and the overall exit yarn tension is about 85 mg/d for a tension gate of about 80 mg/d in total. See Table 1 for other operating conditions.

In situations where it is desirable to achieve only a low tension gradient (e.g. 5 mg/d) across a free-wheeling roll or rolls, or situations where it is desirable to limit the tension gradient across such rolls, it may be necessary to assist the rotation of one or more tension gate rolls. In other words, a free-wheeling roll has sufficient bearing friction and air drag that it may be difficult to achieve a tension gradient of only about 5 mg/d, because the total rolling resistance may exceed the tension gradient. To achieve a low tension gradient, it may be desirable to assist the rolls in their rotation by employing a turbine drive wherein air is employed to help drive the rolls. Operating the rolls with turbine drives or with very sensitive secondary assistance such as electric motors is well within the scope of the skilled artisan and within the present invention.

Figure 9:
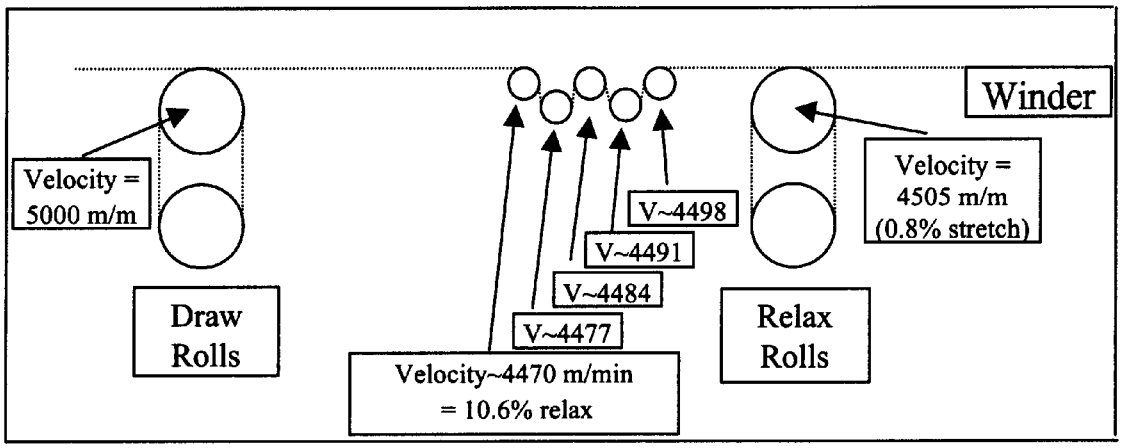
FIG. 9 schematically illustrates the use of five rolls as the tension gate.

FIG. 9 illustrates the use of five rolls positioned within the relax zone of a yarn production process. The velocity of the first roll in the tension gate device is about 4470 meters per minute, which provides a 10.6% relax. Each subsequent roll is gradually increased in velocity such that the tension increases step wise as one proceeds from the first roll to the fifth roll of the tension gate device. Lastly, the relax roll has a velocity of 4505 meters per minute which represents a 0.8% stretch or increase in tension between the first roll of the tension gate device and the relax rolls. This final tension on the relax rolls is easily sufficient to provide yarn stability on the relax rolls to insure no breakage of the yarn and to insure uniform winding. FIG. 9 also illustrates how more rolls increase the amount of stretch in the tension gate, which reduces the amount of total relax in the process.

Yarn temperature determines yarn modulus, which affects the amount of stretch in the tension gate, thus there is an advantage to cooling yarn prior to the tension gate. Cooling the yarn reduces the amount of stretch and improves the final HAS. Additional cooling methods such as cool air or water spray are also within the scope of the present invention.

Figure 10:
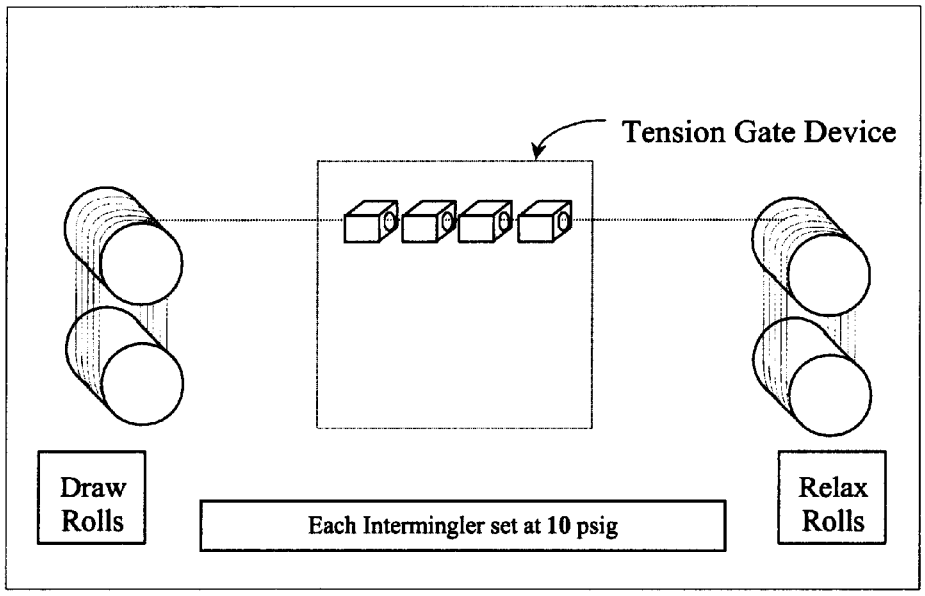
FIG. 10 schematically illustrates the use of four serial interminglers as the tension gate.

FIG. 10 illustrates a tension gate device employing 4 interminglers each operating at 10 psig. The tension gate device achieves a yarn tension gradient of 12 mg/d. A greater tension gate can be achieved by the addition of more interminglers, or operating the 4 interminglers at higher air pressures. See Table 1 for other operating details.

Figure 11:
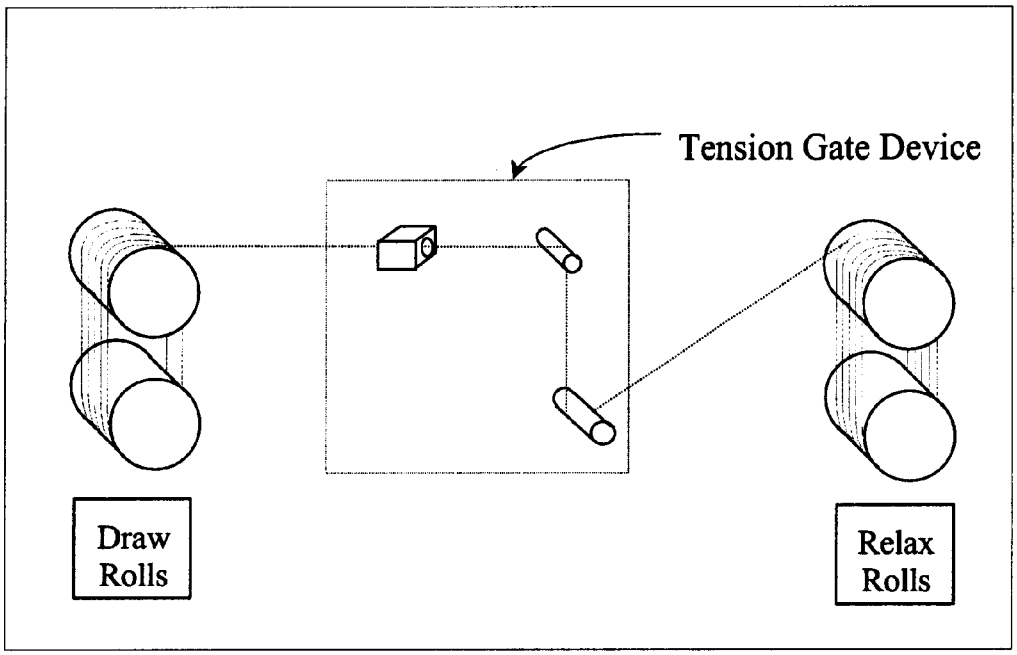
FIG. 11 schematically illustrates a combination of one intermingler and two rolls as the tension gate device.

FIG. 11 shows a combination of devices constituting the tension gate. The pair of rolls illustrated in FIG. 8 is preceded by an intermingler operated at 40 psig of air pressure. Additionally the first roll in the tension gate device is turbine driven, rather than freewheeling as in FIG. 8. The relax zone tension entering the tension gate device is 25 mg/d and the exit tension is 102 mg/d leaving a tension gate of 77 mg/d. The tension after the intermingler is 31 mg/d, giving a tension gradient size for the intermingler of 6 mg/d. Lastly, the final tension between the last roll in the tension gate and the relax rolls is 102 mg/d. This gives a tension gradient between both of the rolls of 71 mg/d. See Table 1 for other operating details.

Figure 12:
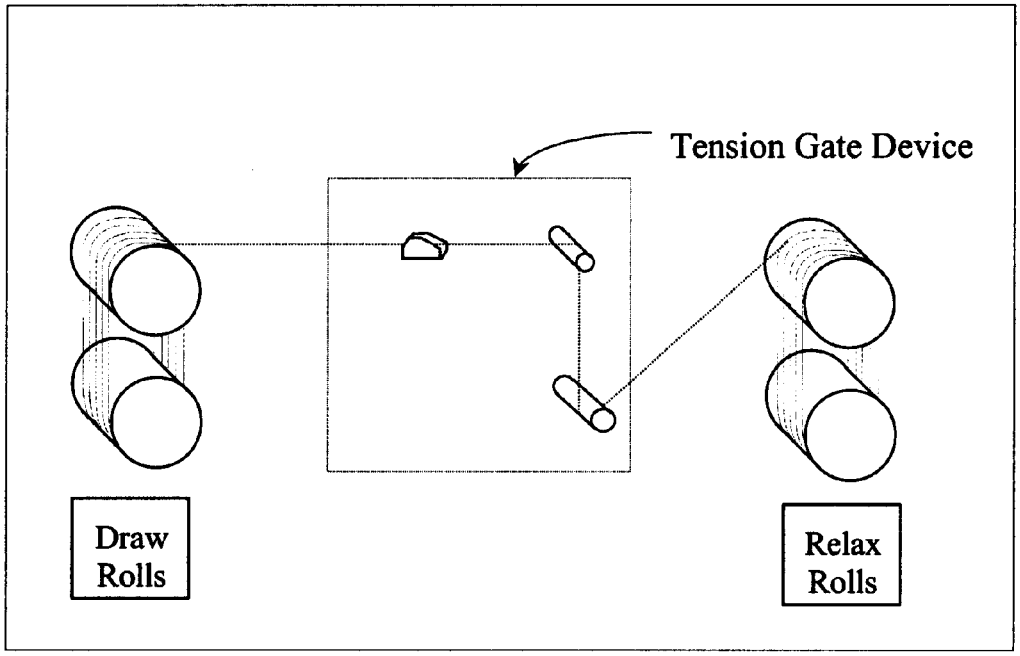
FIG. 12 schematically illustrates the combination of a finish applicator and two rolls as the tension gate.

FIG. 12 shows another combination of devices. The tension gate device includes a finish applicator followed by a turbine driven roll and a free-wheeling roll. The yarn is separated from the solid surface of the applicator by a liquid film. The finish applicator physically contacts the yarn in addition to applying an aqueous coating thereon The finish applicator introduces approximately 13 mg/d of tension in the yarn threadline while the tension across the first turbine roll only introduces an additional 6 mg/d of tension while the second non-turbine roll introduces an addition 50 mg/d of tension at a speed of 5000 meters per minute. The finish applicator applied aqueous based fluid at the rate of about 5.6 ml / min for the 1000 denier yarn. The minimum amount of fluid is whatever is necessary to form a liquid film between the applicator and the yarn. If the contact area of the liquid film and the yarn is increased, or the viscosity of the fluid is increased, the amount of drag is increased. Varying one or more of these factors permits one skilled in the art to "dial-in" any desired amount of drag. The tension gate device illustrated in FIG. 12 demonstrates an overall tension gate of 69 mg/d. See Table 1 for other operating details.

TABLE 1

Conditions for FIGS. 8 and 10–12
Note: All spun yarn IVs = 0.88 at a constant draw roll speed of 5000 m/min.

| FIG. | Description of Tension Gate | % Relax | Heat Set Temp (° C.) | Tension Entering Tension Gate (mg/den) | Tension Exiting Tension Gate (mg/den) |
|---|---|---|---|---|---|
| 8 | Two free-wheeling Rolls | 9.6 | 250 | 5 | 85 |
| 10 | Four Interminglers | 7.5 | 244 | 45 | 57 |
| 11 | Intermingler + 2 Rolls | 7.75 | 245 | 25 | 102 |
| 12 | Liquid Applicator + a turbine driven roll and a free-wheeling roll | 9.75 | 250 | 8 | 77 |

The heat set temperature is the temperature of the draw rolls. The heat set time is the time the yarn first contacts the draw rolls until it leaves the draw rolls. For all of the tension gates in Table 1, the heat set time is 0.224 second and corresponds to 16 wraps on the draw rolls.

Thus it is apparent that there has been provided in accordance with the invention a process and an apparatus that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and the broad scope of the claims.

What is claimed is:

1. In a yarn relaxing process having a low tension relax zone, comprising: providing a tension gate in said relax zone, said tension gate creating a tension differential on said yarn of at least five milligrams per denier, said tension gate comprising one or more of an air drag device or a liquid drag device.

2. In the yarn relaxing process of claim 1, wherein said air drag device comprises an intermingler or a countercurrent flow of air device.

3. In the yarn relaxing process of claim 1, wherein said liquid drag device comprises a finished applicator or a pool of liquid in the thread line path.

4. In the yarn relaxing process of claim 1, wherein said tension gate comprises one or more interminglers, finish applicators, or a combination of these.

5. In the yarn relaxing process of claim 2, wherein said tension gate is one or more interminglers and each of said interminglers has an air/gas pressure of at least 10 psi.

6. In the yarn relaxing process of claim 3, wherein said tension gate is one or more finish applicators and each finish applicator uses at least a minimum amount of fluid necessary to form a liquid film between the applicator and the yarn.

7. In the yarn relaxing process of claim 1, wherein said yarn is polyester.

8. In a yarn relaxing process having a low tension relax zone, comprising: providing a tension gate in said relax zone, said tension gate creating a tension differential on said yarn of at least five milligrams per denier, said tension gate comprising one or more rolls, and wherein said yarn is polyester.

9. In the yarn relaxing process of claim 8, said one or more rolls comprising a turbine driven roll or free-wheeling roll, or a combination thereof.

10. In a process for relaxing yarn in a draw-twisting, draw-winding, or draw-bulking process while improving the stability of the yarn, comprising: utilizing a tension gate with said relax yarn, said tension gate having a tension differential of at least five milligrams per denier of yarn, and wherein said yarn is polyester.

11. In the yarn process of claim 10, said tension gate comprising one or more of an air drag device, a liquid drag device, or a solid surface contact drag device.

12. In the yarn process of claim 11, wherein said air drag device comprises an intermingler or a counter-current flow of air device.

13. In the yarn process of claim 11, wherein said liquid drag device comprises a finish applicator or a pool of liquid in the thread line.

14. In the yarn process of claim 10, wherein said tension gate comprises one or more interminglers, finish applicators, or rolls, or a combination of these.

15. In a process for relaxing yarn in a spin draw process while improving the stability of yarn, comprising: utilizing a tension gate with said relaxed yarn, said tension gate having a tension differential of at least five milligrams per denier of yarn, said tension gate comprising one or more rolls, and wherein said yarn is polyester.

16. In the process of claim 15, wherein said rolls comprise a turbine driven roll or a free-wheeling roll, or a combination of these.

17. A tension gate device for increasing the tension on yarn, comprising: one or more air drag device or liquid drag device and having a tension differential of at least five milligrams per denier of yarn.

18. The tension gate device of claim 17, wherein said air drag device comprises an intermingler or a counter-current flow of air device.

19. The tension gate device of claim 17, wherein said liquid drag device comprises a finish applicator or a pool of liquid in the thread line path.

20. A tension gate device for increasing the tension on yarn, comprising the combination of one or more interminglers, one or more finish applicators, and one or more rolls.

21. A tension gate device for increasing the tension on yarn, comprising: one or more interminglers with one or more rolls.

22. A tension gate device for increasing the tension on yarn, comprising: one or more finish applicators with one or more interminglers.

23. A tension gate device for increasing the tension on yarn, comprising: one or more finish applicators with one or more turbine rolls or free-wheeling rolls.

* * * * *